US011353204B2

(12) United States Patent
Singhal

(10) Patent No.: US 11,353,204 B2
(45) Date of Patent: Jun. 7, 2022

(54) ARTICLE AND METHOD OF INSTALLATION OF DC LIGHTING SENSOR

(71) Applicant: Maverick Energy Solutions, Dallas, TX (US)

(72) Inventor: Priyashu Agrawal Singhal, Bloomingdale, IL (US)

( * ) Notice: Subject to any disclaimer, the term of this patent is extended or adjusted under 35 U.S.C. 154(b) by 0 days.

(21) Appl. No.: 17/145,759

(22) Filed: Jan. 11, 2021

(65) Prior Publication Data

US 2021/0215330 A1 Jul. 15, 2021

Related U.S. Application Data

(60) Provisional application No. 62/959,612, filed on Jan. 10, 2020.

(51) Int. Cl.

| | |
|---|---|
| ***F21V 23/04*** | (2006.01) |
| ***F21V 23/00*** | (2015.01) |
| ***F21V 17/12*** | (2006.01) |
| ***F21V 23/06*** | (2006.01) |
| *F21Y 115/10* | (2016.01) |

(52) U.S. Cl.

CPC ..... *F21V 23/0464* (2013.01); *F21V 17/12* (2013.01); *F21V 23/007* (2013.01); *F21V 23/0471* (2013.01); *F21V 23/06* (2013.01); *F21Y 2115/10* (2016.08)

(58) Field of Classification Search

CPC .... F21V 23/0464; F21V 17/101; F21V 23/06; F21V 17/12; F21V 23/0471; F21V 23/007; F21Y 2113/10; F21Y 2115/10

See application file for complete search history.

(56) References Cited

U.S. PATENT DOCUMENTS

| | | | | |
|---|---|---|---|---|
| 10,798,797 | B1 * | 10/2020 | Mahaffey | G01J 5/04 |
| 2011/0062888 | A1 * | 3/2011 | Bondy | H05B 45/3725 315/294 |
| 2011/0291570 | A1 * | 12/2011 | Sinai | H05B 47/115 315/149 |
| 2013/0207552 | A1 * | 8/2013 | Plunk | F21S 8/02 315/152 |

(Continued)

FOREIGN PATENT DOCUMENTS

| | | | |
|---|---|---|---|
| CN | 205038204 U | * | 2/2016 |
| KR | 102195994 B1 | * | 12/2020 |

*Primary Examiner* — Rajarshi Chakraborty
*Assistant Examiner* — Glenn D Zimmerman
(74) *Attorney, Agent, or Firm* — Emerson, Thomson & Bennett, LLC; Roger D. Emerson

(57) ABSTRACT

Disclosed herein is a light fixture including a fixture body for supporting a light source. An aperture is formed in the fixture body, sized and proportioned for receiving a sensor for activating at least one light source received in the fixture body. A removable cover is provided for covering the aperture until the sensor is optionally installed. A power supply provides electrical power to the light source. The sensor includes a photocell that detects a predetermined low light level to activate the light source. A motion sensor detects a predetermined motion level to activate the light source. A timer measures a predetermined period of time of no movement at the motion sensor to reduce the light level. A retaining structure retains the sensor in the aperture formed in the fixture body.

15 Claims, 14 Drawing Sheets

(56) References Cited

U.S. PATENT DOCUMENTS

| | | | | |
|---|---|---|---|---|
| 2016/0023894 | A1* | 1/2016 | Xu | B81B 7/0058 257/415 |
| 2018/0160507 | A1* | 6/2018 | Feeney | G06F 3/011 |
| 2018/0160509 | A1* | 6/2018 | Treible, Jr. | G01V 8/12 |

* cited by examiner

ARTICLE AND METHOD OF INSTALLATION OF DC LIGHTING SENSOR

This application claims the benefit of U.S. Provisional Application No. 62/959,612, entitled ARTICLE AND METHOD OF INSTALLATION OF DC LIGHTING SENSOR, filed Jan. 10, 2020, which is fully incorporated herein by reference.

I. BACKGROUND

Light fixtures are commercially available for a variety of lighting applications. Some types of lighting fixtures are available with pre-installed sensors, either for detecting motion, ambient light, or both. Such sensors can be used to activate the light fixture or otherwise change the operational state of the light.

In a typical implementation, sensors are installed on the fixtures by default. Customers wanting to purchase a light fixture may have to pay an increased price for a fixture that includes the sensor, despite not having a use for it. Thus, purchasing light fixtures can pose an unnecessary economic burden. Therefore, a need exists for providing a fixture with an optional sensor.

II. SUMMARY

The present invention includes a light fixture and a method of making in which sensors can be optionally retrofitted in the field onto existing units or configured on new units at the time of purchase. A light fixture without sensors can be modified by adding one or more holes in a fixture body to allow one or more sensors to be added. The resulting modified light fixture results in cost savings to customers by not requiring a light fixture to include a sensor if a sensor is not needed.

Additionally, installation is simplified since a sensor can be plugged in to an already existing circuit provided on the fixture, saving time and therefore money. As modified according to the present method, a fixture would look aesthetically more clean, as the sensor would be retained inside the fixture, optionally behind a lens covering the fixture, and would not be visible on the outside, as with many common types of current light sensors.

The invention pertains to a light fixture with an optional DC lighting sensor and methods of installation of such a sensor into existing light fixtures. Specifically, the disclosed method of installing the sensor includes installing pre-cut holes into the light fixture or perforations that can be removed and replaced by said sensor. The present invention thus includes a light fixture with an optional sensor and a method to modify existing light fixtures for installing a sensor.

In accordance with one aspect of the present invention, a fixture is provided that includes an option of adding a sensor.

In accordance with another aspect of the invention, a DC sensor is used as an alternative to an AC sensor.

In accordance with still another aspect of the present invention, the installed sensor can dim the lights by a percentage, depending on the light surrounding the sensor and whether the sensor detects motion.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

FIGS. 13A-E depict exemplary outdoor light fixtures that can be used with the present optional sensor in accordance with an exemplary embodiment of the present invention.

IV. DETAILED DESCRIPTION

Figure 1:
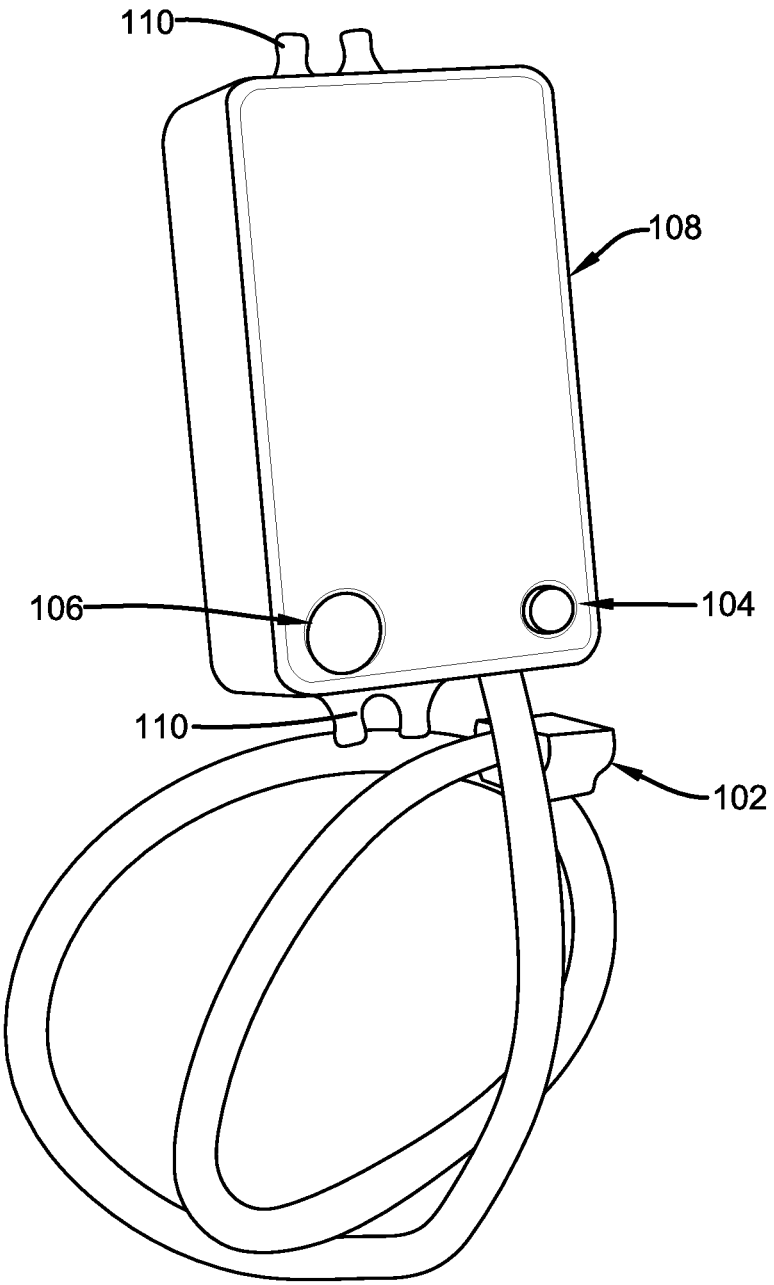
FIG. 1 is a perspective view of the DC sensor in accordance with an exemplary embodiment of the present invention.
Figure 2:
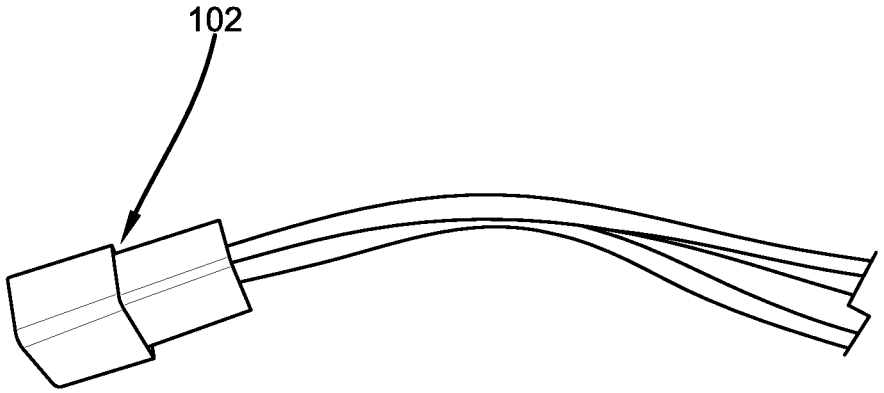
FIG. 2 is a perspective view of the terminal for the 12V DC sensor in accordance with an exemplary embodiment of the present invention.

Referring now to the drawings wherein the showings are for purposes of illustrating embodiments of the invention only and not for purposes of limiting the same, and wherein like reference numerals are understood to refer to like components, FIGS. 1 and 2 depict aspects at a DC sensor 108 in accordance with the present invention.

Figure 3:
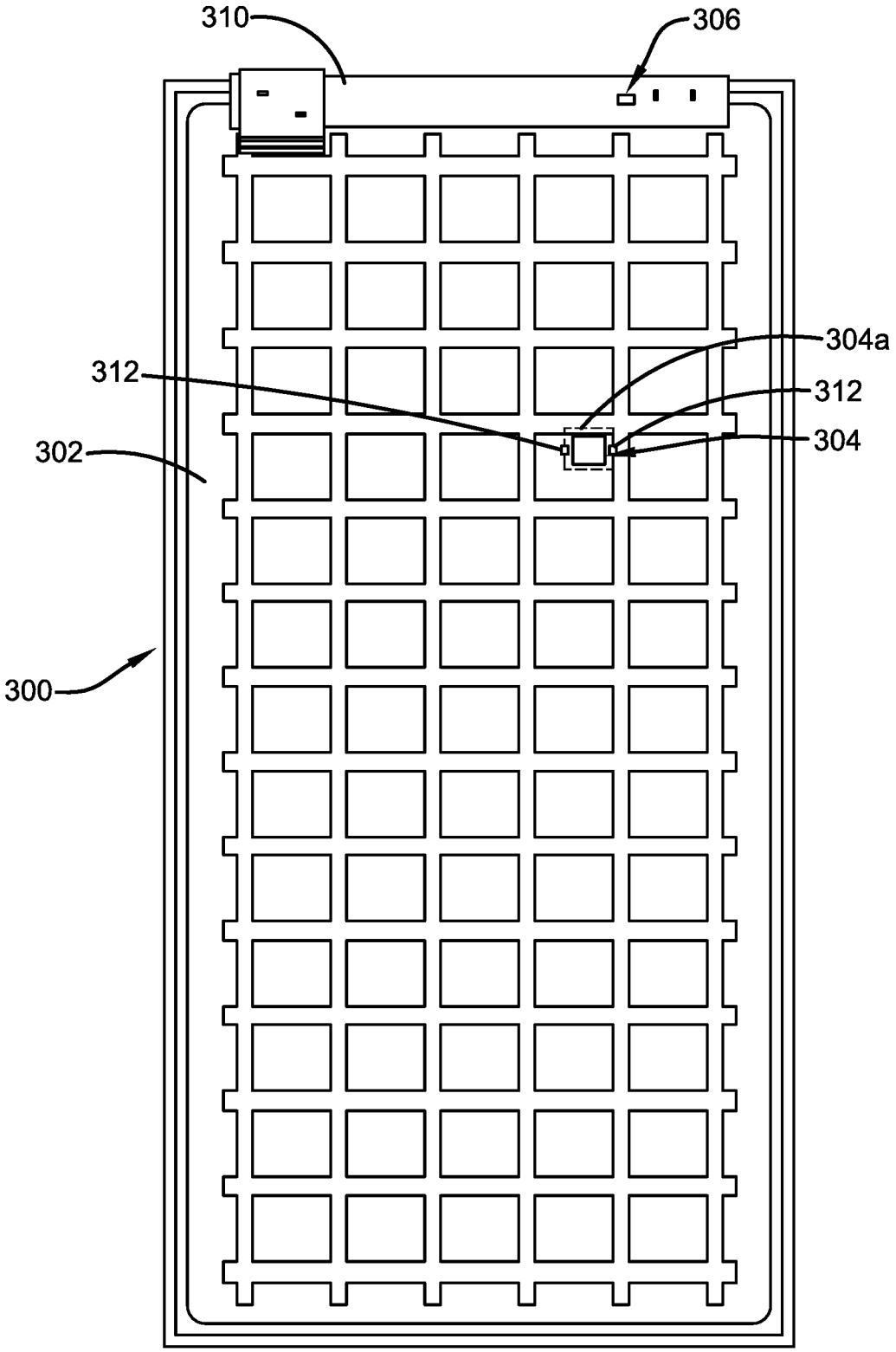
FIG. 3 is a top planar view of the light fixture in accordance with an exemplary embodiment of the present invention.
Figure 4:
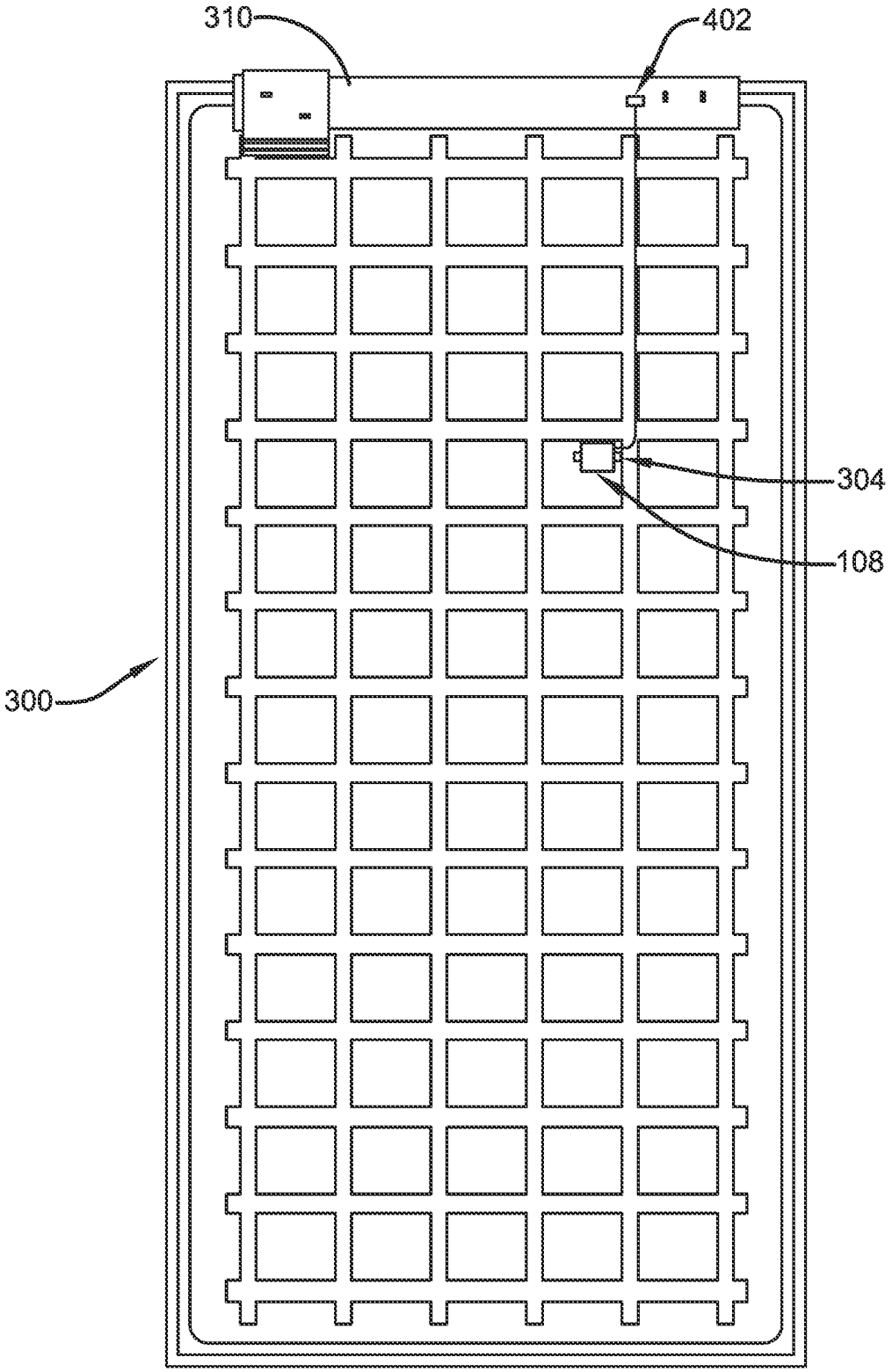
FIG. 4 is a top planar view of the light fixture in accordance with an exemplary embodiment of the present invention.

A terminal is provided for powering the 12V DC Sensor 102, When powered on, a photocell 104 in the sensor 108 measures ambient light in a surrounding area such that, upon detecting a predetermined low light level, the photocell 104 generates a signal to activate the light source if the area is too dark. A motion sensor 106 is used to detect motion such that, upon detection of a predetermined motion level, the motion sensor 106 generates a signal to activate the light source. First, the photocell 104 senses whether the room is dark or not, then the motion sensor 106 detects movement. If no movement is detected after a period of time, the sensor 108 could dim the lights a percentage, based on the ambient light. A timer measures a predetermined period of time such that, upon detecting no movement at the motion sensor, the light level of the light source is reduced by a predetermined amount;

FIG. 3-4 shows a top planar view of the light fixture 300 including a fixture body in the form of a panel 302, which can be a flat substrate panel upon which is mounted or formed a plurality of light sources, such as LEDs. A pre-cut hole or aperture 304 is provided in the panel 302, sized and proportioned for receiving the sensor 108. The pre-cut hole 304 can be covered with a removable sticker 304*a* to prevent dust from falling through prior to optional installation of the sensor 108. A driver box 310 is provided and includes a build 306 which is an outlet for making an electrical connection and thereby supplying electricity to a suitable connector, which can be a 3-pin connector from outside the build 306.

FIG. 4 shows the light fixture 300 after modification and installation of the DC sensor 108. The sticker 304*a* that covered the pre-cut hole 304 is removed. The DC sensor 108 is installed in the pre-cut hole 304, after which the sticker 304*a* is replaced over the DC sensor 108 to keep dust out of the fixture.

The DC sensor 108 can be held in place by a variety of suitable alternative components. For example, the DC sensor 108 includes plastic tabs 110 (as shown in the FIG. 1) that can cooperate with screw holes 312 formed on the panel 302 around the outside perimeter of the pre-cut hole 304, so that screws can be inserted through the screw holes 312 to engage the tabs 110. Alternatively, magnets can be provided on the sensor 108 and proximate to the pre-cut hole 304, either around an internal perimeter or on the fixture 300 behind the panel 302. The DC sensor 108 has a female connector 102 which is plugged into a male connector 402 on the build 306 of the driver box 310.

Figure 5:
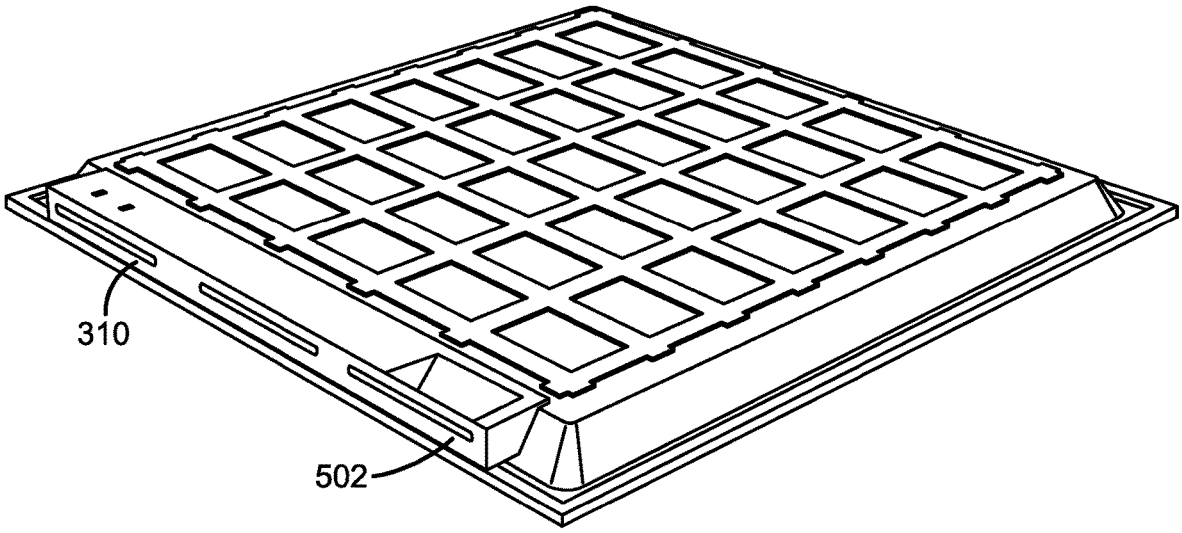
FIG. 5 is an isometric view of bottom of the light fixture in accordance with an exemplary embodiment of the present invention.
Figure 6:
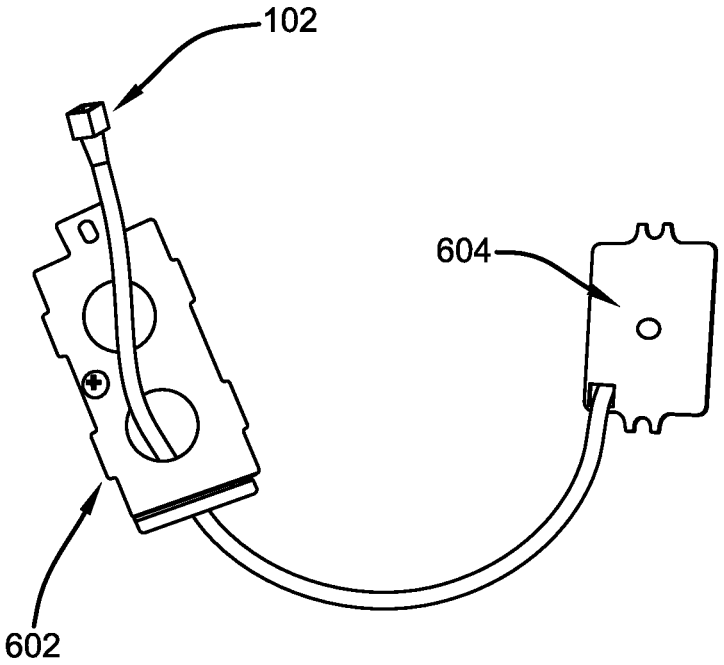
FIG. 6 is a perspective view of a proprietary 12V DC sensor and plate used to cover a junction box in accordance with an exemplary embodiment of the present invention.

In another exemplary embodiment, as depicted in FIGS. 5-6, a junction box 502 is provided where a separate DC output wire can be placed. FIG. 6 shows a proprietary 12V DC sensor 604 of the type provided by Maverick. This sensor 604 has a terminal 102 for the 12V DC Sensor 604, which would connect to a suitable mating component inside the junction box 502. The junction box 502 is covered using the metal plate 602.

Figure 7:
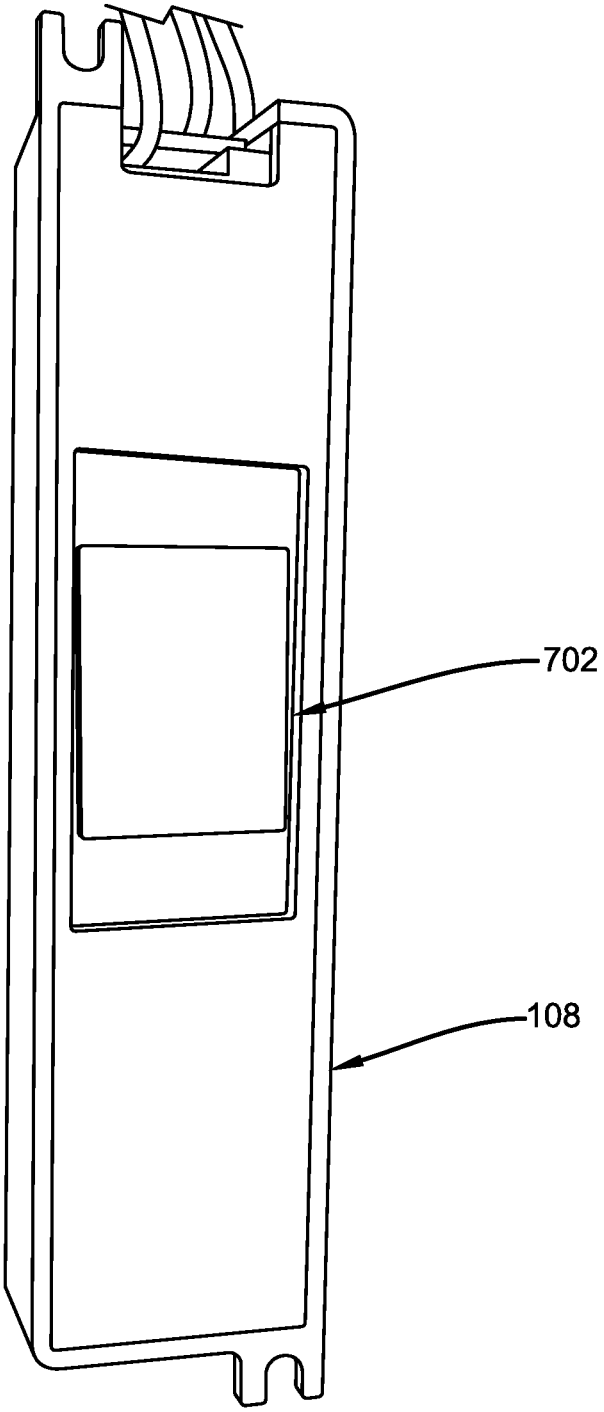
FIG. 7 is a bottom planar view of the sensor in accordance with an exemplary embodiment of the present invention.

In another exemplary embodiment of the invention, referenced in FIGS. 7-10, a DC output connection is built on a PC board. In FIG. 7, the DC sensor 102 is shown with a sticky adhesive backing 702 on its back to keep it in place against the fixture 300 upon installation through the pre-cut hole 304.

Figure 8:
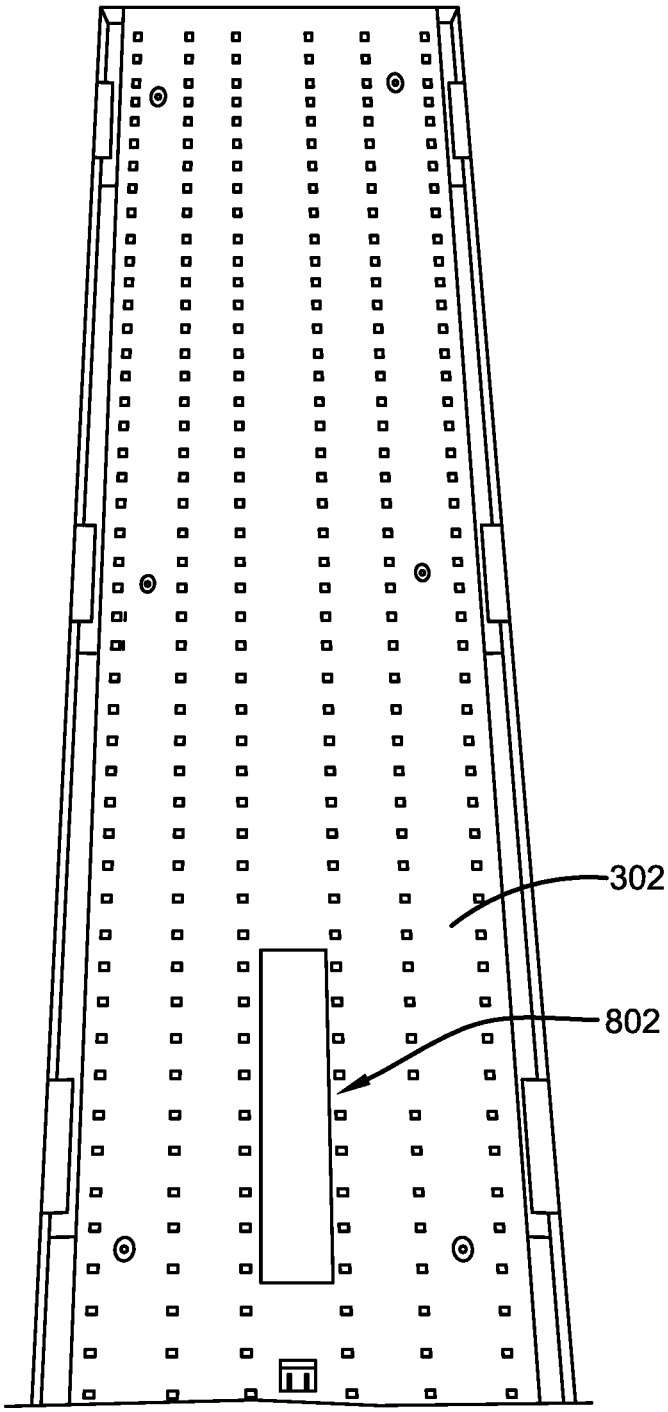
FIG. 8 is a top planar view of the light fixture in accordance with an exemplary embodiment of the present invention.

FIG. 8 is a top planar view of the fixture with a pre-cut perforation 802 which is formed into the panel 302. The pre-cut perforation 802 can be optionally removed to provide the hole for optional installation of a sensor 108. However, the pre-cut perforation 802 provides a finished appearance for end use implementations where a sensor 108 is not installed, so that the panel 302 does not include an unnecessary hole.

Figure 9:
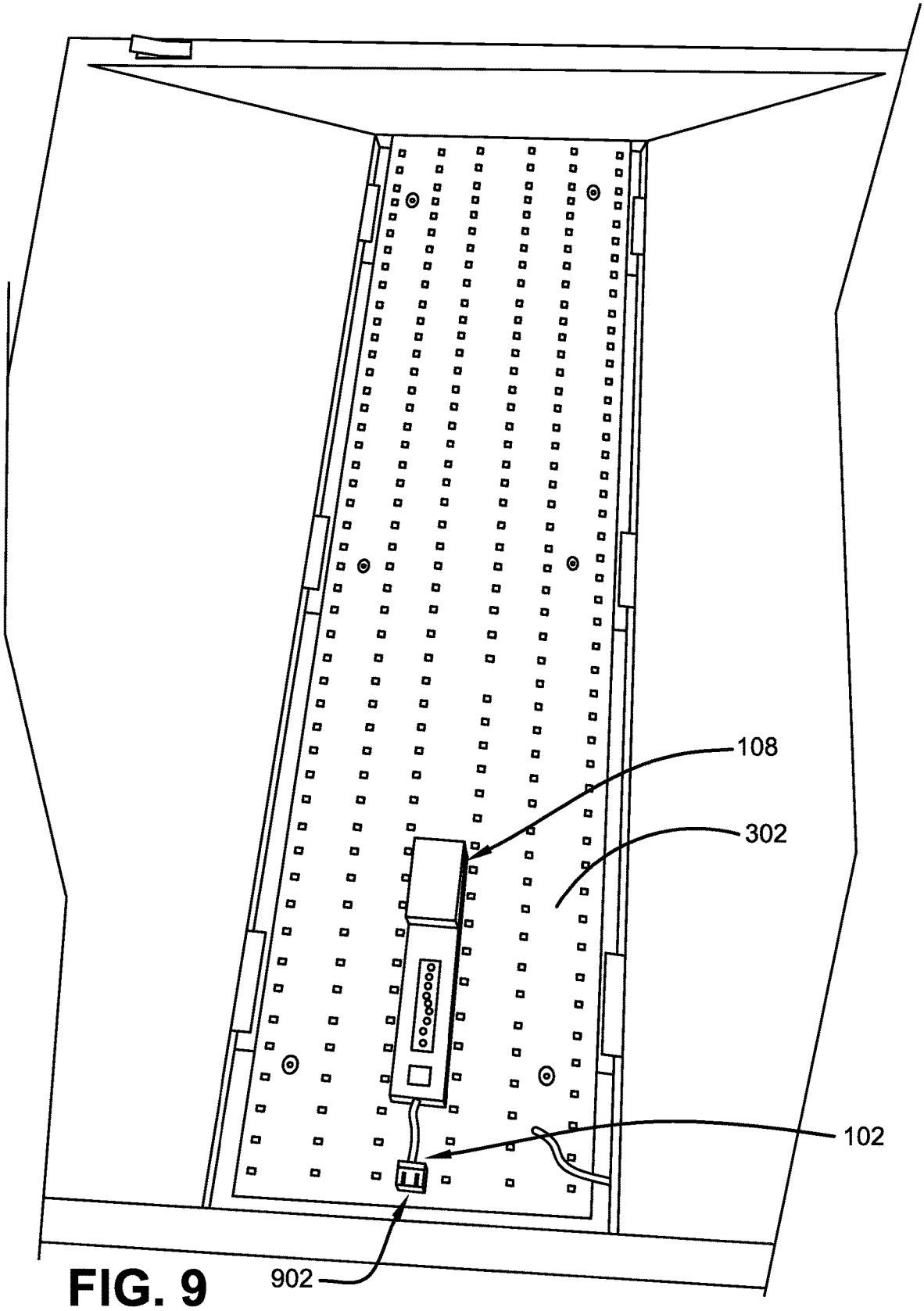
FIG. 9 is a top planar view of the light fixture in accordance with an exemplary embodiment of the present invention.

FIG. 9 shows an end use implementation in which the pre-cut perforation 802 is removed and the DC sensor 108 installed in the hole created thereby. The terminal 102 for the 12V DC sensor is plugged into a connector 902 formed directly onto the printed circuit board (PCB) forming the panel 302.

Figure 10:
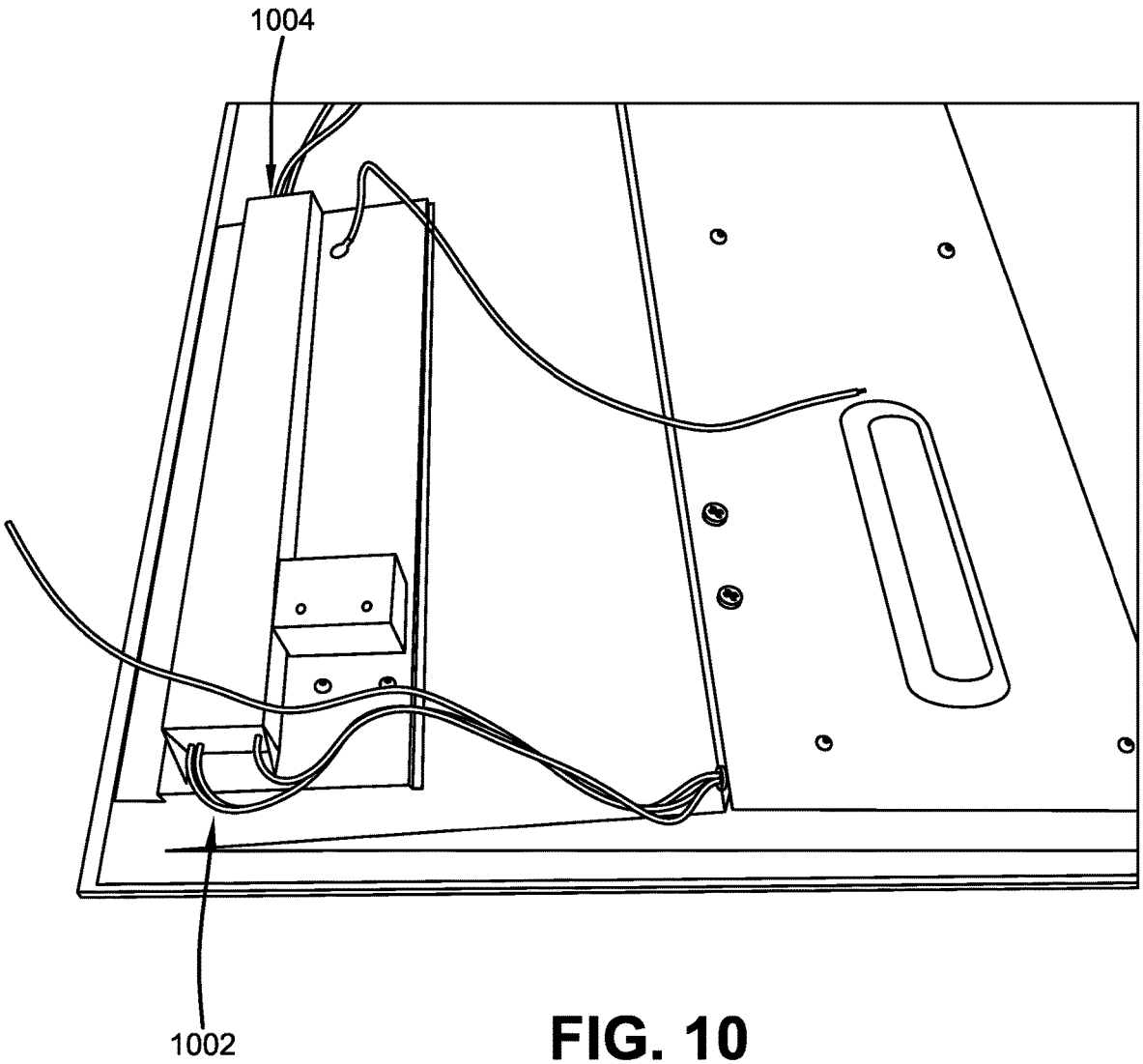
FIG. 10 is the backside of the light fixture in accordance with an exemplary embodiment of the present invention.

With reference to FIG. 10, the back side of the fixture 300 is shown. An LED Driver 1004 is shown connected with the extra 12V DC output 1002. This is advantageous since an AC to DC convertor is not required. Such an AC to DC converter adds additional expense and is time consuming and further requires a junction box to conceal the AC to DC converter.

A method is now disclosed herewith for making the product as disclosed herein above. In a first embodiment, a perforated pre-cut hole is formed in a panel of a light fixture. The pre-cut hole is covered with a removable sticker. The sticker can be removed to allow a DC sensor to placed down into the hole. The same sticker or another sticker is placed over the sensor to keep dust out of the fixture. The DC sensor is then held in place using either magnets formed on the sensor and panel or screws penetrating the panel that retain plastic tabs on the sensor. A female 3-pin connector of the sensor is connected to a male connector on the driver box.

A second embodiment is similar to the first embodiment except the driver box has a separate DC output connection that is located in the junction box. A perforated pre-cut hole is made on the panel and covered with a sticker. The sticker can be removed to allow the DC sensor to be placed down into the hole. The same or another sticker is placed over the sensor to keep dust out of the fixture. The DC sensor is then held in place using either magnets formed on the sensor and panel or screws penetrating the panel that retain plastic tabs on the sensor. A female 3-pin connector of the sensor is connected to a male connector on the driver box.

A third embodiment has a DC output connection built directly on the PCB board. A pre-cut perforation is formed onto the panel, which is concealed behind a lens that covers the light fixture. A DC sensor is installed by removing the pre-cut perforation and placing the sensor into the newly created hole. The DC sensor is then held in place using either magnets formed on the sensor and panel or screws penetrating the panel that retain plastic tabs on the sensor. A female 3-pin connector of the sensor is connected to a male connector on the driver box.

Figure 11A:
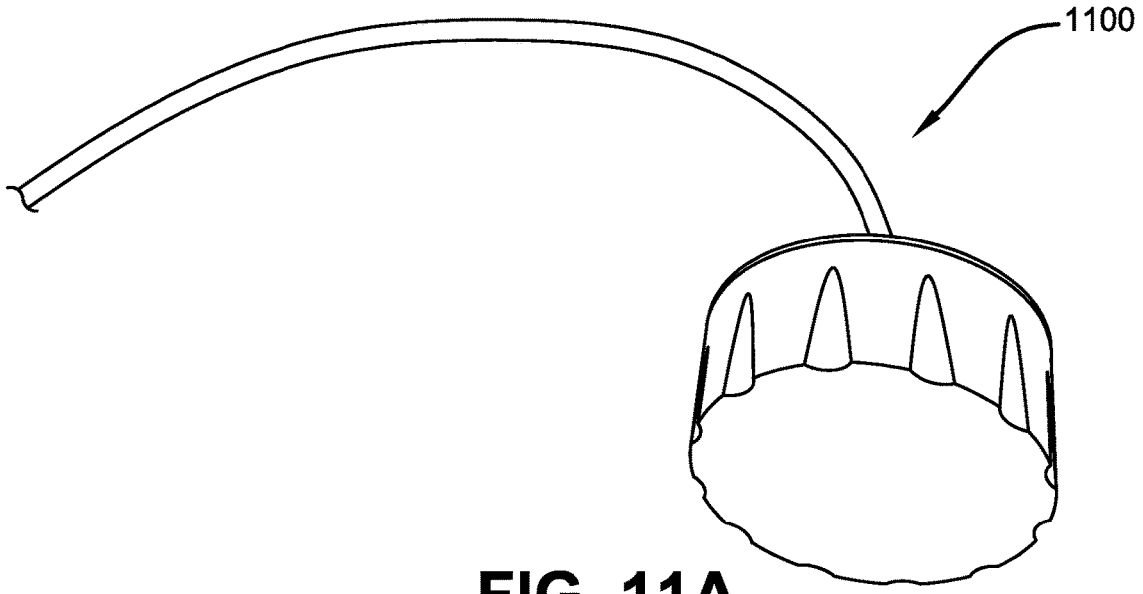
FIGS. 11A and 11B are perspective views of a control for a light fixture in accordance with an exemplary embodiment of the present invention.
Figure 11B:
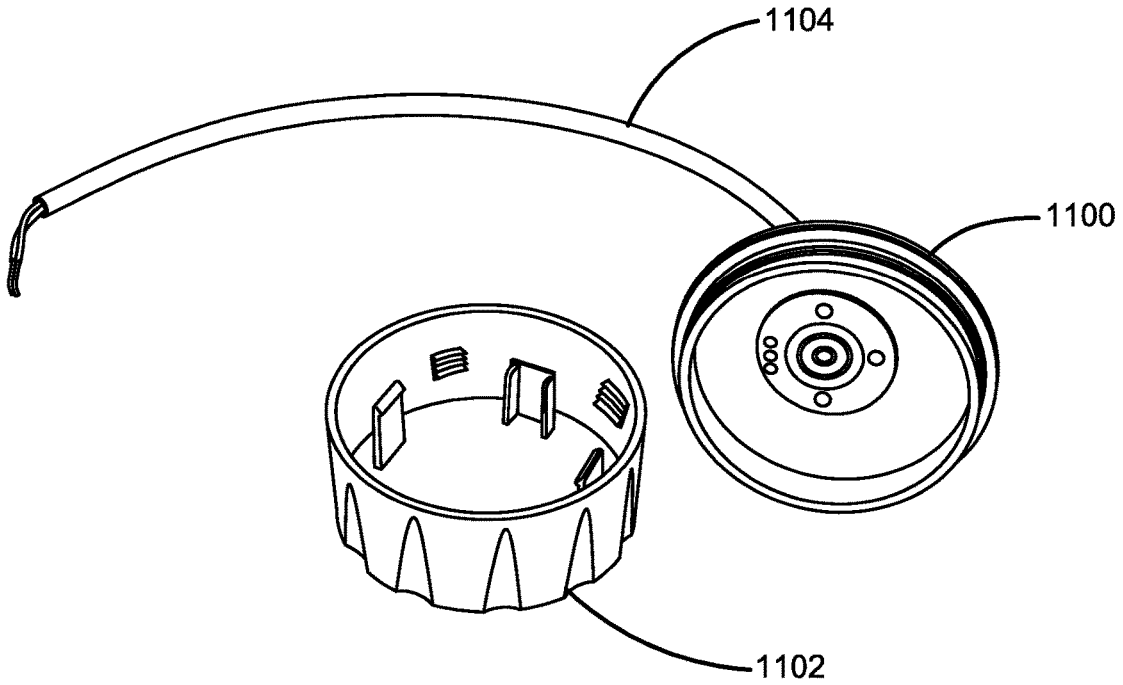

FIGS. 11A, 11B, 12A, 12B, and 13A-E depict various aspects of employing the DC sensor with outdoor lighting fixtures in accordance with the exemplary embodiments of the present invention. FIGS. 11A-11B show a control 1100 enclosed within a removable cover 1102 and a connecting wire 1104 and electrical contacts 1106. An outdoor lighting fixture can have such a control 1100 installed as a pre-existing component.

Figure 12A:
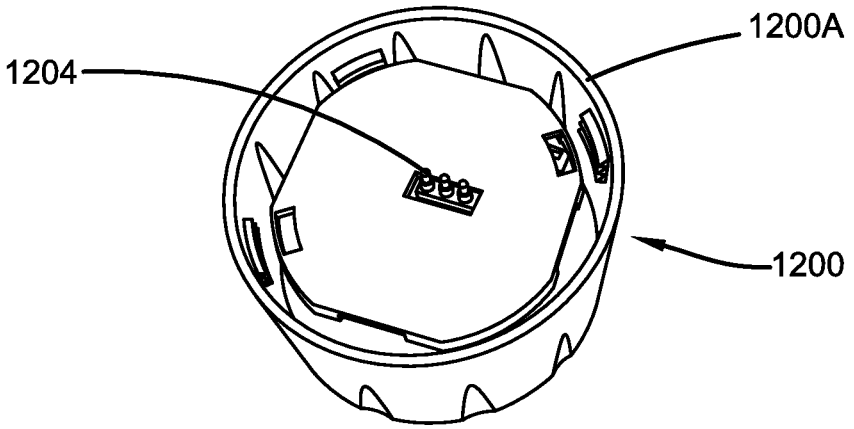
FIGS. 12A and 12B are perspective views of an optional sensor in accordance with an exemplary embodiment of the present invention.
Figure 12B:
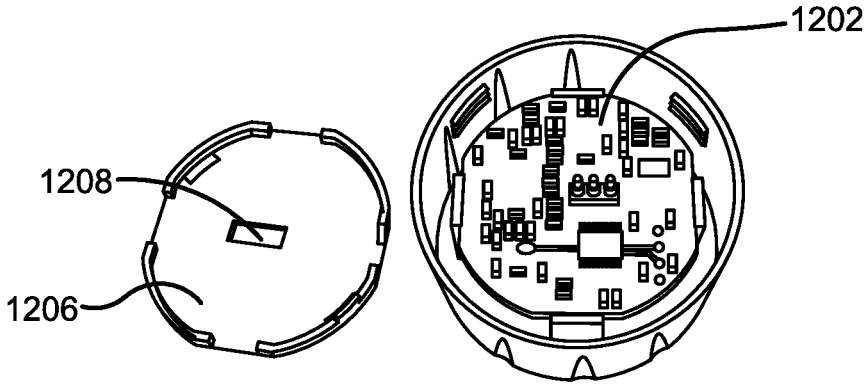

As shown in FIGS. 12A and 12B, the cover 1102 of the control 1100 can be removed and a sensor 1200 can be added in the place of the cover 1102. The sensor 1200 has an outer sensor cover 1200*a* similar in shape and size to the removable cover 1102. The outer cover 1200*a* receives an electronics package 1202 with suitable circuitry and pin connectors 1204 for engaging the electrical contacts 1106 within the control 1100. The sensor 1200 also includes a back plate 1206 to protect the electronics package 1202 and having an aperture 1208 for admitting the pin connectors 1204. In this manner, the sensor 1200 can be optionally installed to the control 1100 depending on the needs of the end user. In one preferred aspect, the sensor cover 1200*a* and the removable cover 1102 are of different colors. For example, the removable cover 1102 can be white and the sensor cover 1200*a* can be black, to provide an easily identifiable visual indicator of whether or not a sensor 1200 has been installed.

FIGS. 13A, 13B, 13C, 13D, and 13E show exemplary embodiments various outdoor lighting fixtures that can be adapted to optionally receive a DC sensor. The fixtures include a canopy fixture 1300A, a multi-purpose flood fixture 1300B, a shoebox fixture 1300C, a small flood fixture 1300D, and a wall pack fixture 1300E. The fixtures 1300A, 1300B, 1300D, 1300E each include at least one extra 12V DC output 1302A, 1302B, 1302D, 1302E where a sensor can be optionally installed in the field. This sensor can be installed on a new light fixture installation or in a retrofit of an existing light fixture installation.

Figure 13A:
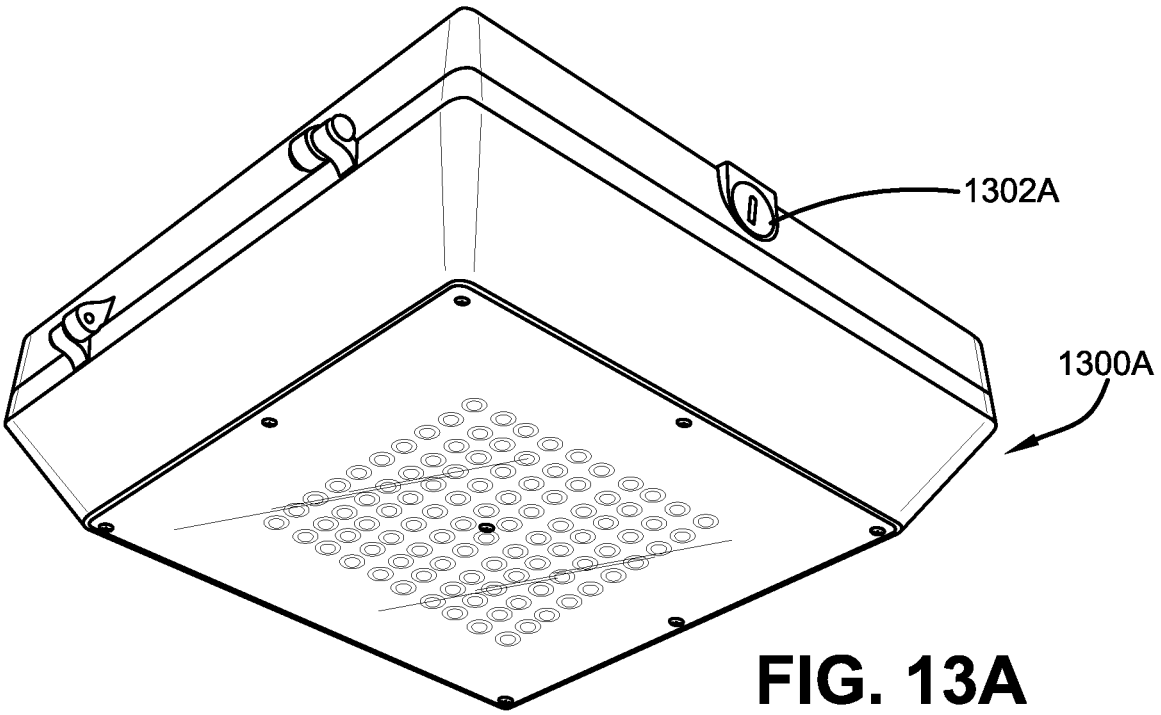
Figure 13B:
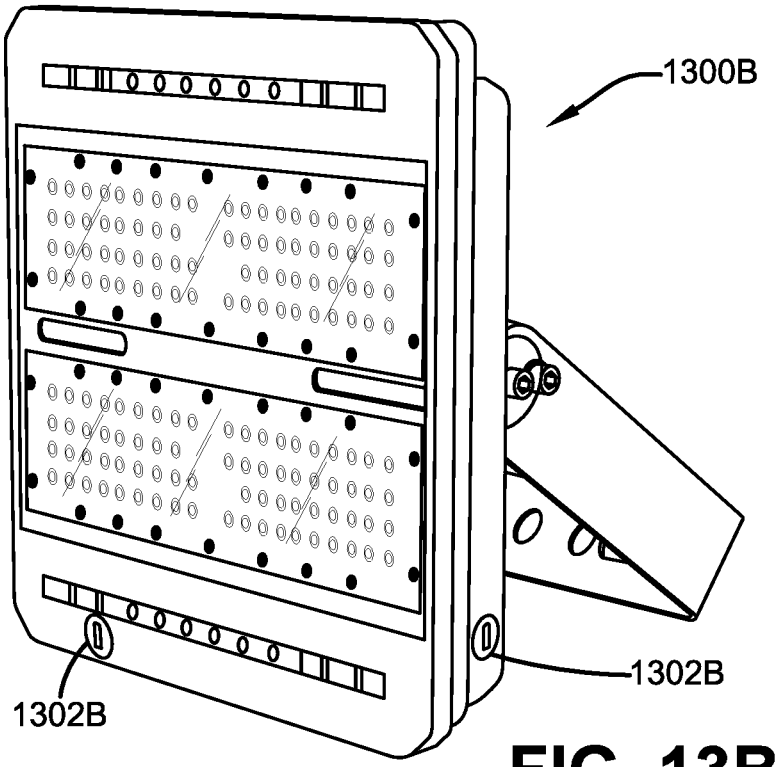
Figure 13C:
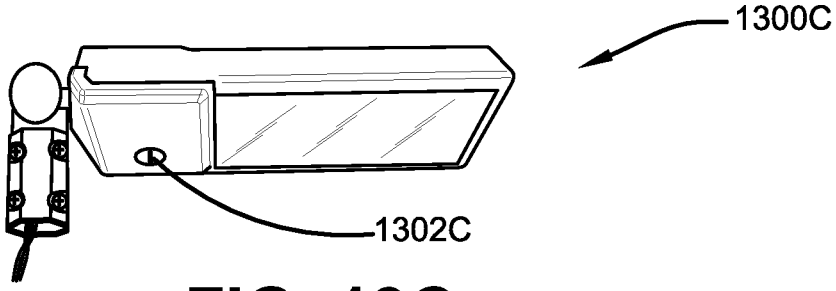
Figure 13D:
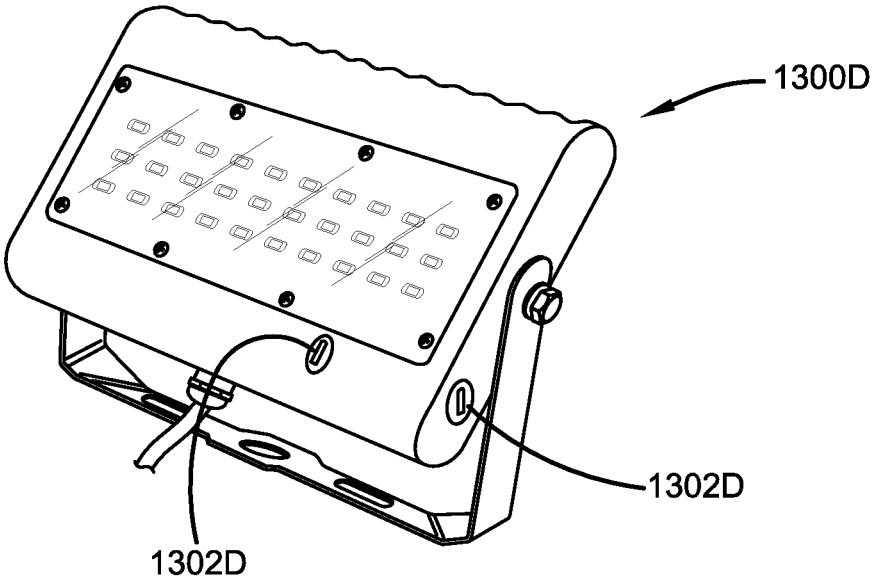
Figure 13E:
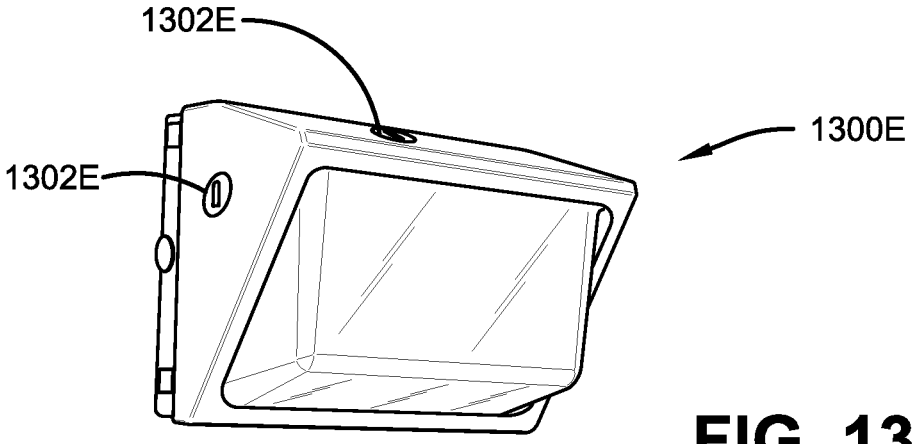

As particularly shown in FIG. 13C, the shoebox fixture 1300C can include a control indicated by a cover 1302C that is mounted externally on the fixture 1300C. The control and cover 1302C are of the type described hereinabove in connection with FIGS. 12A and 12B. The cover 1302C can optionally receive the sensor 1200 as also described hereinabove. It is to be appreciated that the other outdoor lighting fixtures 1302A, 1302B, 1302D, 1302E shown in FIGS. 13A, 13B, 13D, and 13E could also be adapted to include a control with a cover that can optionally receive a sensor 1200 of this type.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

I claim:

1. A light fixture, comprising:

a fixture body comprising a flat substrate panel upon which a plurality of light, sources are mounted;

a pre-cut aperture formed in the flat substrate panel, sized and proportioned for receiving a sensor for activating at least one light source received in the fixture body;

a removable sticker for covering the pre-cut aperture until the sensor is optionally installed;

a power supply that provides electrical power to the light source;

wherein the sensor comprises:

a photocell that measures ambient light in a surrounding area such that, upon detecting a predetermined low light level, the photocell generates a signal to activate the light source;

a motion sensor that detects motion such that, upon detection of a predetermined motion level, the motion sensor generates a signal to activate the light source;

a timer that measures a predetermined period of time such that, upon detecting no movement at the motion sensor, reducing a light level of the light source by a predetermined amount; and a retaining structure for retaining the sensor in the pre-cut aperture formed in the fixture body.

2. The light fixture of claim 1, wherein the sensor includes a sensor cover having a shape and size substantially similar to a removable cover of the light fixture.

3. The light fixture of claim 1, wherein the retaining structure of the sensor comprises tabs that cooperate with screws inserted into screw holes formed on the panel around an outside perimeter of the pre-cut aperture so that screws can be inserted through the screw holes to engage the tabs.

4. The light fixture of claim 1, wherein the retaining structure of the sensor comprises an adhesive backing on the sensor to retain the sensor at a desired position against the fixture upon installation through the pre-cut aperture.

5. The light fixture of claim 1, wherein the retaining structure of the sensor comprises at least one first magnet provided on the sensor that cooperates with at least one second magnet proximate to the pre-cut aperture on the panel, wherein the at least one second magnet is situated on at least one of an internal perimeter of the pre-cut aperture or behind the panel.

6. The light fixture of claim 1, wherein the plurality of light sources comprises a plurality light emitting diodes (LEDs).

7. The light fixture of claim 1, wherein the power supply comprises one of:

a driver box including a build for supplying electricity to an electrical connector that plugs into a mating connector on the sensor;

a junction box including a separate DC output wire, wherein the sensor includes a terminal that connects to a mating component inside the junction box; and a DC output connection formed on a printed circuit board (PCB) forming the panel for connecting to the sensor.

8. The light fixture of claim 1, wherein the pre-cut aperture is a pre-cut perforation formed into the panel, optionally removed to provide a hole for optional installation of the sensor and optionally providing a finished appearance for end use where the sensor is not installed.

9. The light fixture of claim 1, wherein the removable sticker for covering the pre-cut aperture is removed upon optional installation of the sensor and replaced over the sensor to keep dust out of the fixture body.

10. The light fixture of claim 2, wherein the sensor sticker and the removable cover are of different colors to provide an easily identifiable visual indicator of whether the sensor has been installed in the fixture body.

11. The light fixture of claim 2, wherein the sensor comprises a backplate having an opening for admitting pin connectors for engaging a socket in the fixture body connected to the power supply.

12. A method, comprising:

providing a fixture body for supporting a light source;

providing a sensor comprising, a photocell that measures ambient light in a surrounding area such that, upon detecting a predetermined low light level, the photocell generates a signal to activate the light source;

a motion sensor that detects motion such that, upon detection of a predetermined motion level, the motion sensor generates a signal to activate the light source;

a timer that measures a predetermined period of time such that, upon detecting no movement at the motion sensor, reducing a light level of the light source by a predetermined amount;

wherein the method further comprises, providing a pre-cut aperture formed in the fixture body, sized and proportioned for receiving the sensor for activating at least one light source received in the fixture body;

providing a removable sticker over the pre-cut aperture;

removing the sticker from the aperture;

inserting the sensor into the aperture;

connecting the sensor to a power supply for the light source;

replacing the sticker over the sensor inserted in the aperture.

13. The method of claim 12, further comprising retaining the sensor in place in the fixture body with one of: screws penetrating the fixture body that engage tabs on the sensor; or a first magnet formed on the sensor that cooperates with a second magnet formed in the fixture body.

14. The method of claim 12, further comprising providing a driver box with an output connection located in a junction box, for providing electrical power to a connector of the sensor.

15. The method of claim 12, further comprising a printed circuit board having an output connection formed thereon, for providing electrical power to a connector of the sensor.

* * * * *